United States Patent [19]

Whitaker, Jr.

[11] Patent Number: 4,890,557

[45] Date of Patent: Jan. 2, 1990

[54] INTERSTITIAL BALLAST VIBRATOR

[75] Inventor: John B. Whitaker, Jr., Wetumpka, Ala.

[73] Assignee: Kershaw Manufacturing Company, Inc., Montgomery, Ala.

[21] Appl. No.: 296,670

[22] Filed: Jan. 13, 1989

[51] Int. Cl.[4] ..... E01B 29/04

[52] U.S. Cl. ..... 104/7.3; 104/2; 104/7.1; 104/307

[58] Field of Search ..... 104/7.3, 2, 7.2, 7.1, 104/307; 171/16; 37/104–107, 97

[56] References Cited

U.S. PATENT DOCUMENTS

| | | | |
|---|---|---|---|
| 3,811,382 | 5/1974 | Buchter et al. | 104/7.3 |
| 4,538,686 | 9/1985 | Theurer et al. | 171/16 |
| 4,563,826 | 1/1986 | Whitaker, Jr. | 37/97 |
| 4,705,115 | 11/1987 | Whitaker, Jr. | 104/7.3 X |
| 4,770,104 | 9/1988 | Theurer | 104/7.2 |
| 4,799,430 | 1/1989 | Theurer | 104/2 |

*Primary Examiner*—Douglas C. Butler

*Attorney, Agent, or Firm*—Jennings, Carter, Thompson & Veal

[57] ABSTRACT

An attachment for railroad track maintenance equipment utilizes a parallelogram linkage to position a vibrating skid on the surface of the interstitial ballast intermediate railroad crossties to loosen such ballast for subsequent removal by an undercutter device which is a part of the track maintenance equipment.

23 Claims, 2 Drawing Sheets

Fig. 2
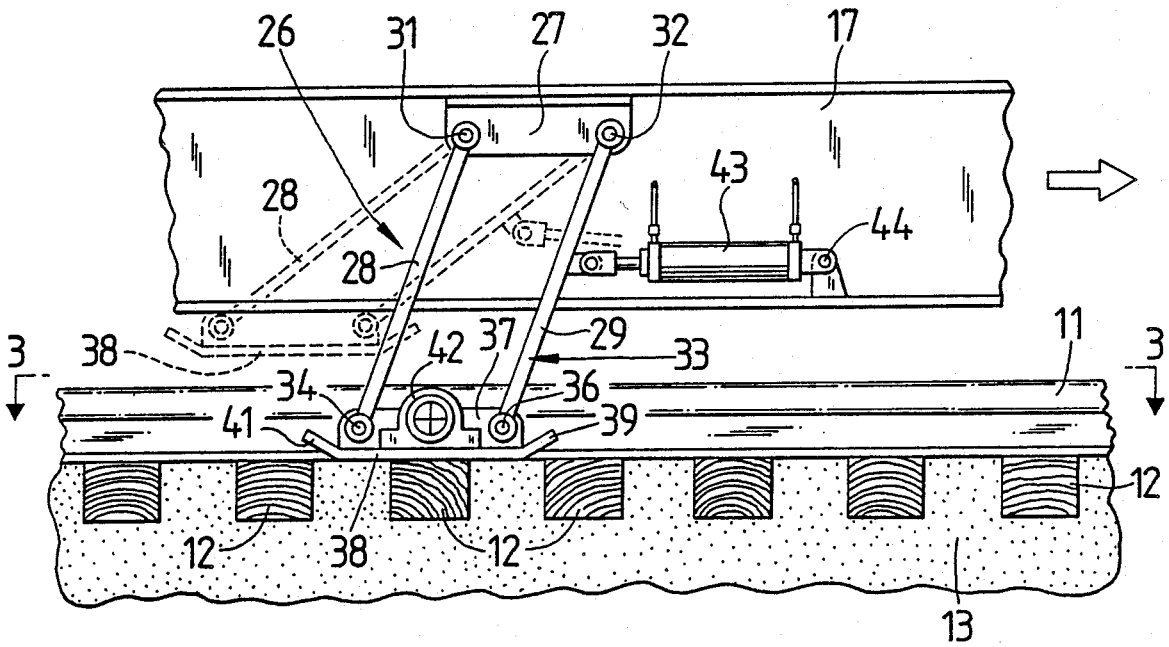
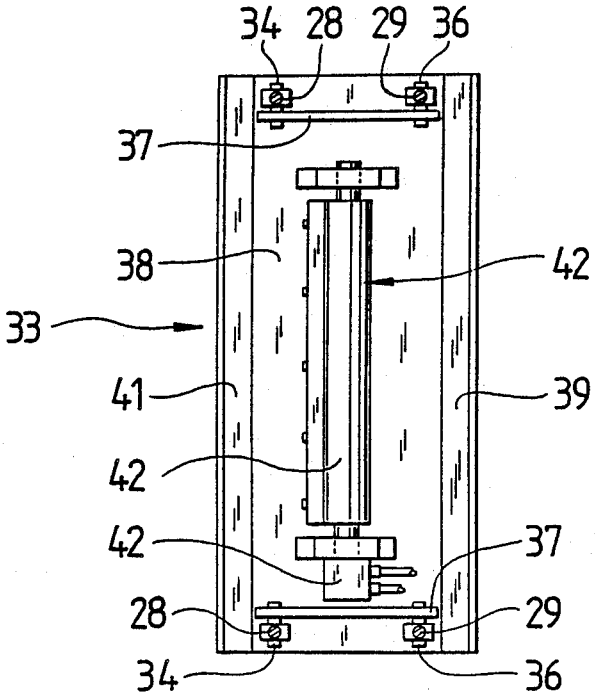
Fig. 3

INTERSTITIAL BALLAST VIBRATOR

FIELD OF THE INVENTION

The present invention relates generally to railroad track maintenance equipment and more specifically to apparatus used in removing dirty or deteriorated ballast from along the track bed. More particularly, the present invention relates to apparatus for use in conjunction with other apparatus to loosen compacted ballast between the crossties of a railroad track.

BACKGROUND OF THE INVENTION

Modern railroad track maintenance equipment typically includes a self-propelled unit having an apparatus for trenching alongside the ends of the crossties and an apparatus for removing ballast from beneath the track. The track remains intact and the machinery is supported on the track rails. The removed ballast is replaced by clean ballast such that the track is not left in an unsupported condition. In many instances the ballast between the crossties has been compacted by years of vibration and settling and thus is tightly wedged between the ties such that when the undercutter removes the ballast from beneath the ties, the interstitial ballast remains suspended between the crossties. Obviously if the ballast is not removed it can impair the proper placement of the replacement ballast. In general, however, the condition is a nuisance. In times past crews have manually loosened the interstitial ballast with hammers; in other instances the track is lifted and bowed to allow the ballast to loosen. However, although the rails are somewhat plastic, lifting the rails necessitates repositioning and realigning and is of some concern. Accordingly, there is perceived a need for a simple and efficient attachment for loosening interstitial ballast.

SUMMARY OF THE INVENTION

It is the object of the present invention to loosen interstitial ballast from between the crossties of a railroad track for subsequent removal by an undercutter.

It is a further object of the present invention to effect such loosening without deformation of the rails of the railroad track.

Still another object of the invention is to permit proper placement of the replacement ballast beneath and between the crossties.

Each of these objects are advantageously achieved in the present invention through the use of a novel vibrator assembly which utilizes the density of the ties and ballast to its advantage to loosen the ballast without impact or interstitial displacement of a tool. Specifically by apparatus is designed to contact the top of the crossties and the ballast therebetween and to impart vibration to the mass such that the ballast is loosened. A vibrational frequency of 30 to 60 hertz should adequately loosen the ballast. The vibration may be induced in any suitable manner, however, it has been found convenient to mount a rotating eccentrically balanced shaft on an extended plate in the form of a skid. Rotation of the shaft at the desired speed induces vibration in the plate which transmits the vibration to the underlying ballast. The effectiveness of the device is influenced by the effective weight of the vibrating unit. The effective weight of the vibrating unit may be controlled by the mounting structure which is a parallelogram linkage connecting the vibrating unit to a carriage or propulsion unit. A positioning ram is used to urge the linkage laterally to position the vibrating unit at a selected height and to apply a selected downward component of force to achieve a desired "effective weight".

BRIEF DESCRIPTION OF THE DRAWINGS

Apparatus embodying features of the invention are depicted in the accompanying drawings which form a portion of this disclosure and wherein:

FIG. 2 is a detailed elevational view showing the invention as incorporated in the machinery.

FIG. 3 is a sectional view taken along line 3—3 of FIG. 2.

DESCRIPTION OF A PREFERRED EMBODIMENT

Figure 1:
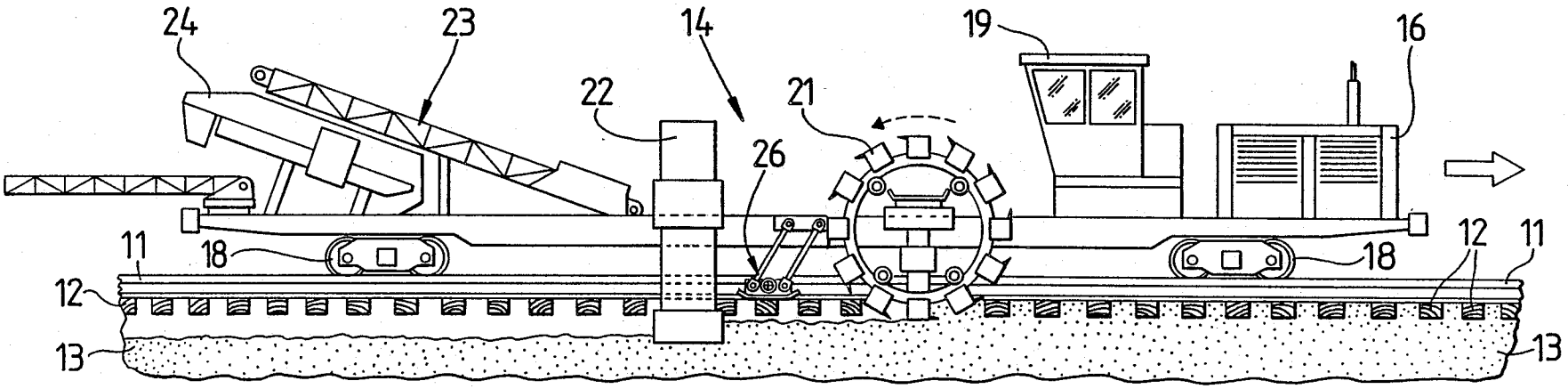
FIG. 1 is a side elevational view of the type machinery with in the invention may be incorporated.

Referring to FIG. 1, it will be noted that a railroad track has three principal components: the rails 11, the crossties 12, and the ballast 13 which forms the bed upon which the crossties 12 and rails 11 are supported and leveled. As is well known in the art, the ballast 13 must be periodically serviced to replenish and restore it to a proper bed which will maintain the track in a safe operating condition. As seen in FIG. 1 this is oftentimes accomplished with a self-propelled track maintenance unit 14 which travels along the track removing and replacing ballast 13 as it goes. Such a unit 14 is typically powered by a diesel engine 16 mounted on an elongated frame or carriage 17 supported on track-engaging wheels 18. An operator compartment 19 contains the controls necessary to operate the engine 16, a trencher 21 which excavates alongside the ends of the crossties 12, an undercutter 22 which removes ballast 13 from beneath the crossties 12, a conveyor system 23 which transports ballast 12 from the undercutter 22 to a cleaning unit 24 which segregates the ballast into a waste portion which is removed from the track and a cleaned portion which is returned to the bed of ballast 13 behind the undercutter. The foregoing is well known in the art and will not be discussed further.

The present invention is a ballast vibrator attachment 26 to be used as a component in the track maintenance unit 14. As may be seen in FIG. 1, the ballast vibrator attachment is preferentially positioned aft of the trencher 21 and forward of the undercutter 22. In this location it will be appreciated that the ballast 13 between the ties 12 are already subject to a degree of vibration due to the lateral action of the trencher 21 and the approaching undercutter 22.

With reference to FIG. 2, it can be seen that the ballast vibrator attachment 26 is supported from the frame or carriage 17 on a mounting flange 27. A pair of parallel support arms 28 and 29 are affixed to the flange 27 with pins 31 and 32 such that the arms 28 and 29 may pivot in a vertical plane aligned with the direction of travel indicated by the arrow. The lower ends of arms 28 and 29 are affixed to a vibrating unit 33 with a set of pins 34 and 36 which pass through an upstanding attachment member 37 which is affixed to a skid plate 38. The skid plate 38 spans the interstice between the crossties 12 and has upturned forward and rear end portions 39 and 41 which prevent entanglement with exposed edges of the crossties 12. Mounted to the top of the skid plate 38 is a vibrator 42 which may be an eccentric shaft or wheel 42' driven for rotation by a hydraulic motor 42 supplied with hydraulic fluid in a conventional manner from the maintenance unit 14 as shown in FIG. 3.

Attached by a pin connected to arm 29 is a linear actuator 43, which is preferentially a double acting cylinder, which is pivotally mounted at 44 to the frame 17 and is also supplied with hydraulic fluid from the maintenance unit 14. The actuator 43 urges the arm 29 laterally, thus changing the angular orientation of the parallelogram and the elevation of the vibrating unit 33.

As will be appreciated the downward component of force on the skid plate 28 may be varied by the force applied by actuator 43, thus the operator may selectively apply greater or lesser or varying force as may be necessary to dislodge the interstitial ballast 13 wedges between the crossties 12.

While I have shown my invention in one form, it will be obvious to those skilled in the art that it is not so limited but is susceptible of various changes and modifications without departing from the spirit thereof.

What I claim is:

1. Apparatus for aiding in the removal of ballast from beneath a railroad track during reballasting operations wherein the railroad track remains intact and the ballast is removed by an undercutter underlying the railroad crossties of the track with the undercutter propelled along on a driven carriage comprising in combination:

(a) a vibrating unit resting atop said crossties and the ballast therebetween;

(b) means for attaching said vibrating unit to said carriage for concomitant motion therewith along said railroad track with said vibrating unit preceding said undercutter;

(c) means for raising or lowering said vibrating unit into engagement with said crossties.

2. Apparatus as defined in claim 1 wherein said vibrating unit comprises:

(a) a skid member having a generally planar center section and an upturned forward and rear section adapted to move over said crossties without entanglement therewith; and (b) a driven rotary member mounted on said skid member for imparting vibration thereto.

3. Apparatus as defined in claim 2 wherein said means for attaching comprises a pair of parallel arm members each having an upper end and a lower end and each pivotally mounted to said carriage at said upper end and to said vibrating unit at said lower end.

4. Apparatus as defined in claim 3 wherein said means for raising or lowering said vibrating unit comprises a selectively actuable cylinder having a generally horizontally extending connector attached to one of said arm members and supported by said carriage, such that extension or retraction of said connector causes said arms to pivot beneath said carriage to vertically adjust said vibrating unit.

5. Apparatus as defined in claim 1 wherein said means for attaching comprises a pair of parallel arm members each having an upper end and a lower end and each pivotally mounted to said carriage at said upper end and to said vibrating unit at said lower end.

6. Apparatus as defined in claim 5 wherein said means for raising or lowering said vibrating unit comprises a selectively actuable cylinder having a generally horizontally extending connector attached to one of said arm members and supported by said carriage, such that extension or retraction of said connector causes said arms to pivot beneath said carriage to vertically adjust said vibrating unit.

7. Apparatus for aiding in removing ballast from beneath a railroad track in conjunction with an undercutter apparatus and a propulsion unit comprising:

(a) means for vibrating the surface of the quantity of said ballast between the crossties of said railroad track; and (b) means for urging said means for vibrating along said railroad track forwardly of said undercutter.

8. Apparatus as defined in claim 7 wherein said means for vibrating comprises a plate-like member having a length greater than the separation between said crossties and having upturned forward and rear portions; and an eccentric drive shaft mounted to said plate for imparting vibration thereto.

9. Apparatus as defined in claim 8 wherein said means for urging comprises a pair of parallel support arms pivotally suspended from said propulsion unit forwardly of said undercutter and pivotally affixed to the front and rear of said means for vibrating, such that a parallelogram linkage is defined thereby; and means affixed on one of said support arms and supported by said propulsion unit for urging said support arms laterally to adjust the height of said vibrating means.

10. Apparatus as defined in claim 7 wherein said means for urging comprises a pair of parallel support arms pivotally suspended from said propulsion unit forwardly of said undercutter and pivotally affixed to the front and rear of said means for vibrating, such that a parallelogram linkage is defined thereby; and means affixed on one of said support arms and supported by said propulsion unit for urging said support arms laterally to adjust the height of said vibrating means.

11. An apparatus for dislodging compacted ballast surrounding the crossties of a railroad track comprising:

(a) a platform resting atop the ties; and (b) means for vibrating said platform to loosen the ballast between and underneath said ties.

12. An apparatus as defined in claim 11 wherein said platform comprises a generally flat region contacting said ties and a pair of upturned ends to facilitate movement along an uneven roadbed.

13. An apparatus as defined in claim 12 wherein said means for vibrating comprises a hydraulic motor mounted atop said platform which utilizes an eccentric shaft to induce vibratory motion in said platform.

14. An apparatus as defined in claim 11 wherein said means for vibrating comprises a hdyraulic motor mounted atop said platform which utilizes an eccentric shaft to induce vibratory motion in said platform.

15. An apparatus for removing compacted ballast underlying a railroad track which utilizes a movable frame supported on said track, said apparatus comprising:

(a) a flat skid attached to said frame;

(b) means for inducing vibration in said skid;

(c) means for selectively positioning said skid proximal said track.

16. An apparatus as defined in claim 15 wherein said means for vibrating comprises a hydraulic motor mounted atop said skid, said motor rotating an eccentric shaft to induce vibration in said skid.

17. An apparatus as defined in claim 16 wherein said means for selectively positioning comprises:

(a) a pair of lateral connecting members having an upper end pivotally attached to said frame, said skid being hingably mounted on a lower end thereof; and (b) a linear actuator having a first end pivotally mounted on said frame and a second end attached to one of said connecting members, said actuator positioning said skid in an inoperable travel position beneath said frame or in a working position resting atop a crosstie.

18. An apparatus as defined in claim 17 operating as a component part of a ballast removal system mounted on said frame, said apparatus being positioned forwardly of an undercutter to loosen ballast compacted around said tie.

19. An apparatus as defined in claim 15 wherein said means for selectively positioning comprises:

(a) a pair of lateral connecting members having an upper end pivotally attached to said frame, said skid being hingably mounted on a lower end thereof; and (b) a linear actuator having a first end pivotally mounted on said frame and a second end attached to one of said connecting members, said actuator positioning said skid in an inoperable travel position beneath said frame or in a working position resting atop a crosstie.

20. An apparatus for aiding in removal of compacted ballast from between and underneath the crossties of a railroad track comprising:

(a) a movable frame adapted for travel on said track;

(b) a parallel pair of vertically disposed connecting arms having an upper end pivotally mounted on said frame and extending downward in the direction of said track;

(c) a generally flat skid plate hingably affixed to said connecting arms on the lower ends thereof and resting atop said ties;

(d) a hydraulic motor mounted atop said plate, said motor rotating an eccentric shaft to induce vibration in said plate;

(e) a horizontally disposed linear actuator having a first end pivotally mounted to said frame and a second end medially affixed to one of said connecting arms.

21. An apparatus as defined in claim 20 wherein said skid plate has upturned edged to facilitate sliding movement among said ties.

22. An apparatus as defined in claim 21 wherein said linear actuator selectively positions said skid plate in an inoperative travel position adjacent said frame or in a working position resting atop said ties.

23. An apparatus as defined in claim 22 wherein said linear actuator selectively positions said skid plate in an inoperative travel position adjacent said frame or in a working position resting atop said ties.

* * * * *